United States Patent [19]

Escaravage

[11] Patent Number: 4,569,544

[45] Date of Patent: Feb. 11, 1986

[54] LATCH STRUCTURE, IN PARTICULAR FOR AN AUTOMOBILE VEHICLE

[75] Inventor: Gérard Escaravage, Valentigney, France

[73] Assignee: Aciers et Outillage Peugeot, Audincourt, France

[21] Appl. No.: 450,842

[22] Filed: Dec. 17, 1982

[30] Foreign Application Priority Data

Dec. 22, 1981 [FR] France ..... 81 23916

[51] Int. Cl.[4] ..... E05C 3/26

[52] U.S. Cl. ..... 292/216; 292/201; 292/252

[58] Field of Search ..... 292/216, 201, 252, 210, 292/108, 229

[56] References Cited

U.S. PATENT DOCUMENTS

| | | | |
|---|---|---|---|
| 2,864,636 | 12/1958 | Pickles | 292/216 |
| 3,354,583 | 11/1967 | Moorman et al. | 292/201 X |
| 3,473,835 | 10/1969 | Boyriven | 292/252 X |
| 3,547,476 | 12/1970 | Nockemann | 292/216 |
| 3,785,186 | 1/1974 | James et al. | 292/216 X |
| 4,177,656 | 12/1979 | Davis | 292/229 X |
| 4,203,621 | 5/1980 | Noel et al. | 292/216 |
| 4,270,783 | 6/1981 | Sorensen et al. | 292/201 X |
| 4,468,941 | 9/1984 | Bascou | 292/201 X |

FOREIGN PATENT DOCUMENTS

| | | | |
|---|---|---|---|
| 95983 | 12/1983 | European Pat. Off. | 70/276 |
| 2472651 | 3/1981 | France . | |

*Primary Examiner*—Robert L. Wolfe
*Assistant Examiner*—Russell W. Illich
*Attorney, Agent, or Firm*—Sughrue, Mion, Zinn, Macpeak and Seas

[57] ABSTRACT

The latch structure comprises, on one hand, a case (1, 2) for the mechanism (6) of the latch structure and, on the other hand, a keeper (5) which is movable relative to the case (1, 2). The mechanism (6) is provided with a bolt (7) which is pivotable about an axis (8) perpendicular to the movement of the keeper (5) with which the bolt cooperates by a fork-shaped portion (24). An actuating lever (9) of the latch structure is adapted to allow the rotation of the bolt in the direction for releasing the keeper through a locking member (12) interposed between the bolt and the actuating lever. The locking member (12) is movable in one of two elements (7) consisting of the bolt and the actuating lever between a projecting position for rendering the two elements rigid with each other and a retracted position for allowing the free movement of rotation of the bolt relative to the actuating lever. For the purpose of rendering the two elements rigid with each other, the second of the two elements comprises at least one notch (30, 31) in which the locking member (12) is adapted to penetrate. The two elements are mounted in such manner as to be movable away from each other for allowing the locking member to leave the notch provided in the second element.

23 Claims, 24 Drawing Figures

LATCH STRUCTURE, IN PARTICULAR FOR AN AUTOMOBILE VEHICLE

The present invention relates to a latch structure, in particular for the door of an automobile vehicle, of the type comprising, on one hand, a case for the mechanism of the latch structure and, on the other hand, a keeper which is movable relative to the case, the mechanism of the latch structure being provided with a bolt which is pivotable about an axis perpendicular to the direction of movement of the keeper with which the bolt cooperates by a portion in the shape of a fork, and a movable actuating lever for the latch structure which is adapted to allow the rotation of the bolt in the direction for releasing the keeper through a locking means interposed between the bolt and the actuating lever.

Such a latch structure is known from French Pat. No. 2,472,651. The actuating lever of this latch structure comprises a pivotal arm carrying as the locking means a grooved roller which is engaged by its edge against a contoured surface of the bolt so that the roller "rolls" along said surface in the course of the actuation of the latch structure, both in the locking and in the unlocking direction. In order to ensure that the roller is constantly applied against the contoured surface or cam of the bolt, the actuating lever is elastically biased so as to urge the roller against the cam of the bolt with a certain force. This roller is connected to the pivotal arm by a hairpin-shaped spring, one branch of which extends into the groove of the roller.

The grooved roller described in this patent is, it is true, capable of reducing friction between the bolt and the actuating lever and affords in this respect an improvement relative to the conventional technique which generally provides for a direct contact between the cam and the actuating lever.

However, the fact remains that, in this known latch structure, the roller must be elastically urged against the contoured surface or cam of the bolt with a certain force, otherwise there are created instabilities in the positioning of the bolt. The cam further comprises high portions defining stops which abut against the grooved roller so as to lock the bolt. These high portions are necessarily of rather steep slopes and must be passed through by the roller in the course of each opening and closing operation of the latch structure. Thus, notwithstanding the reduction in friction by the use of a "rolling" roller, this arrangement is liable to undergo a premature wear.

Further, the force with which the latch structure must be closed or opened is a direct function of the elastic force with which the roller is urged against the cam. Now, in order to achieve a satisfactory locking, this force must be relatively great. This is liable to result in a certain discomfort for the user or, as the case may be, require automatic control mechanisms of comparatively high power.

An object of the invention is to provide an improved latch structure which avoids the aforementioned drawbacks.

The invention therefore provides a latch structure of the type defined hereinbefore, wherein the locking means is mmounted to be movable in one of two elements consisting of the bolt and the actuating lever between a projecting position for rendering said elements integral with each other and a retracted position for allowing the free movement of rotation of the bolt relative to the lever and, for rendering said elements rigid with each other, the second of said elements comprises at least a notch in which the locking means is adapted to penetrate and the two elements are mounted in such manner as to be movable away from each other for moving the locking means out of the notch provided in said second element.

As a result of these features, no elastically yieldable means is required for maintaining the locking means in permanent bearing relation against a cam surface with a force which must ensure the locking of the latch structure. On the contrary, the locking results from a positive wedging of the locking means between the bolt and the actuating lever which is maintained during the locking of the latch structure, whereas for the unlocking of the latch structure, the locking means is no longer positively locked between said two elements, since said two elements are then separated from each other and their wedging connection which was ensured by the locking means is eliminated.

In the course of the movements which occur during the locking and unlocking of the latch structure, the contacting parts are not in elastic bearing relation to each other and in particular the locking means is subjected to no elastic biasing of great value. Consequently, the wear of the contacting surfaces of these parts is extremely small.

The invention will be described hereafter in more detail with the aid of drawings which show merely one embodiment and in which.

Figure 1:
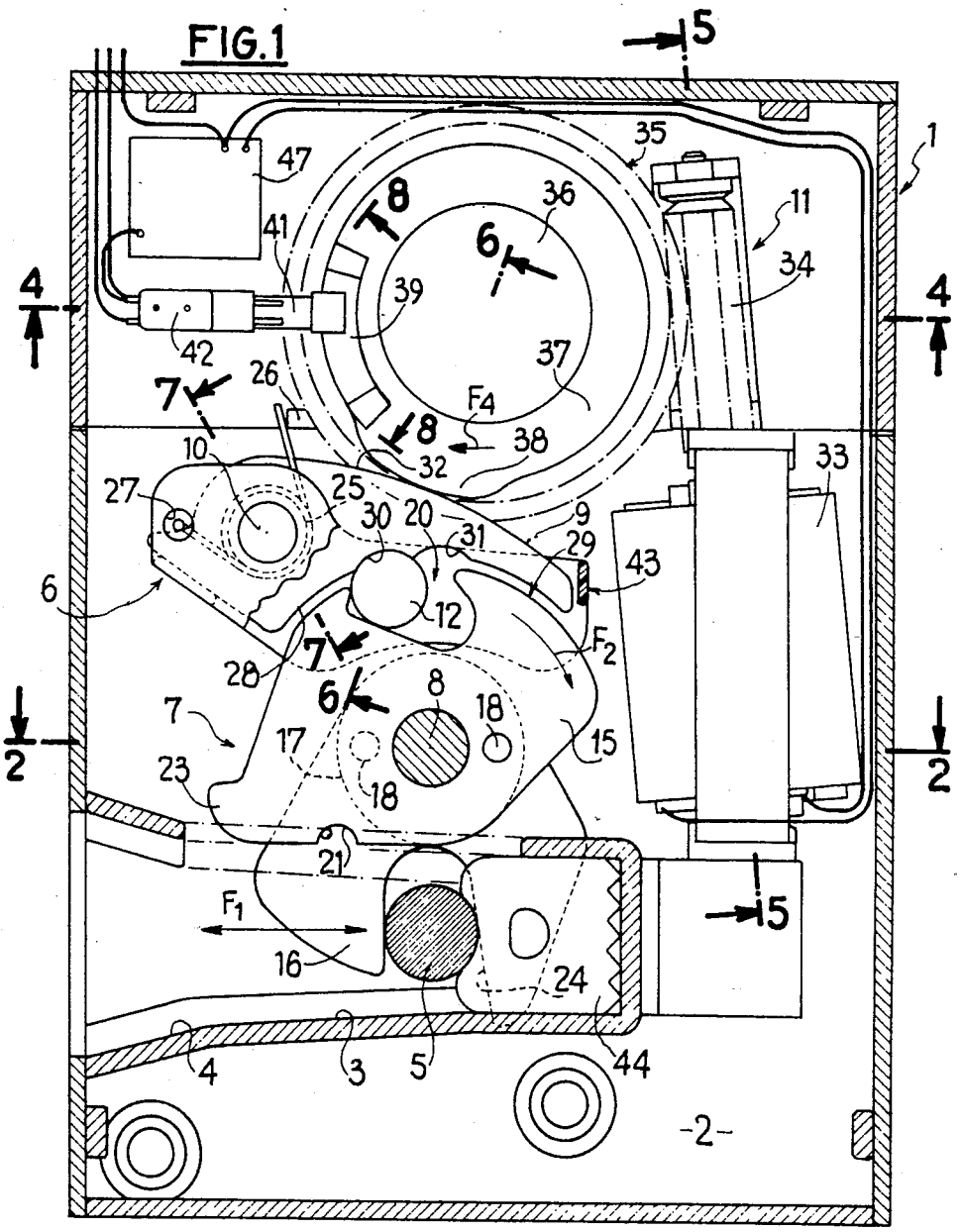
FIG. 1 is an elevational and sectional view of a latch structure according to the invention.

Reference will first be made to FIGS. 1 to 8 to examine the construction of the latch structure in accordance with the preferred embodiment of the invention.

This latch structure comprises, first of all, a case 1 of rectangular shape closed by a cover 2. If the latch structure is employed for a vehicle door, which is a preferred application thereof, this case is placed by its bottom flat against the edge of the door or possibly incorporated in the latter. The case 1 has a transverse blind passage 3 having a tapered entrance 4 in which is adapted to penetrate a keeper 5 which is movable in translation relative to the case. In the application contemplated hereinbefore, this keeper 5, which is a simple portion of a round metal rod, is fixed in the post associated with the door equipped with the case 1.

The latter acts as a housing for a mechanism 6 of the latch structure the main sub-assemblies of which are:

an assembly 7 constituting a bolt pivotally mounted in the case 1 to pivot about a pin 8 whose axis is perpendicular to the direction $F_1$ of movement of the keeper 5;

an actuating lever 9 mounted in the case 1 to pivot about a pin 10 whose axis is parallel to the axis of the pin 8;

an operating unit 11 for the latch structure for allowing the pivoting of the actuating lever about its pivot axis;

a locking means 12 interposed between the assembly constituting a bolt 7 and the actuating lever 9.

Figure 2:
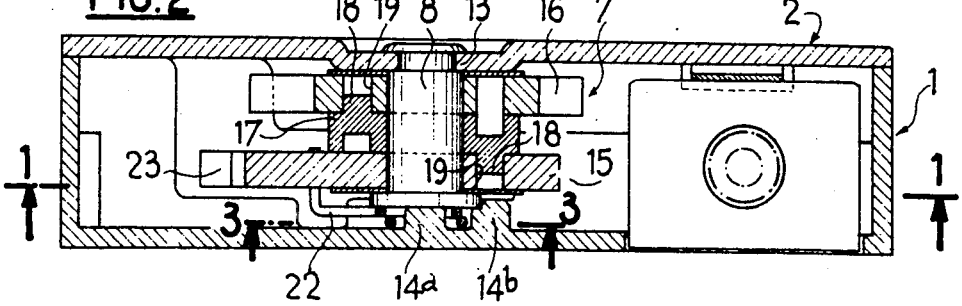
FIGS. 2 to 8 are sectional views taken respectively along corresponding sectional lines indicated in FIG. 1.
Figure 3:
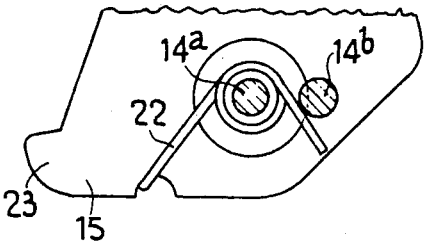

The pivot pin 8 is riveted to the cover 2 as shown at 13 in FIG. 2 and is positioned axially and transversely relative to the bottom of the case 1 by positioning lugs 14*a* and 14*b* which project from this bottom of the case. The body portion of this pin constitutes the pivot axis of two parallel plates 15 and 16 which are connected to rotate together by a spacer member 17 owing to the provision of studs 18 obtained by deformation in opposite directions of said spacer member and engaged in axial apertures 19 provided in the respective plate 15 or 16.

The plate 15 has a first notch 20 which will be described in detail subsequently, a second notch 21 for hooking one of the branches of a return coil spring 22 and a heel portion 23 acting as an abutment. The return spring 22 is engaged on the positioning lug 14*a* of the case 1 (coaxial with the pin 8) and its opposite branch bears against the positioning lug 14*b* which occupies an eccentric position relative to said pin, as shown clearly in FIG. 3. The assembly comprising elements 15, 16, 17, 18 and 19 and forming the bolt 7 is therefore biased by the spring 22 to rotate in the clockwise direction as viewed in FIG. 1 (arrow $F_2$).

The plate 16 has a fork-shaped portion 24 which is adapted to straddle the keeper 5 when the latch structure is locked, as shown in FIG. 1.

The actuating lever 9 (FIGS. 1, 6 and 7) is formed by a slightly arcuate plate which is rotatably mounted on the pin 10 by one of its end portions. This pin 10 is surrounded by a coil spring 25, one of the branches of which is hooked on a stop lug 26 of the cover 2 whereas the other opposed branch is engaged in an aperture 27 of the lever 9 so as to bias the latter in the counterclockwise direction, as viewed in FIG. 1.

The actuating lever 9 has a concave curved edge 28 facing the plate 15 which has a conjugate curved edge 29 of convex shape in which is formed the notch 20. The curved edge 29 of the lever 9 includes two adjacent notches 30 and 31. The edges 28 and 29 have a shape of an arc of a circle. On the opposite side of the plate 15, the actuating lever 9 has a curved edge 32 constituting a cam follower.

Figure 4:
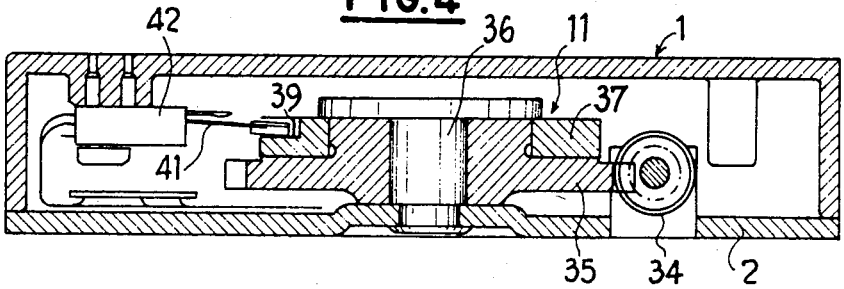
Figure 5:
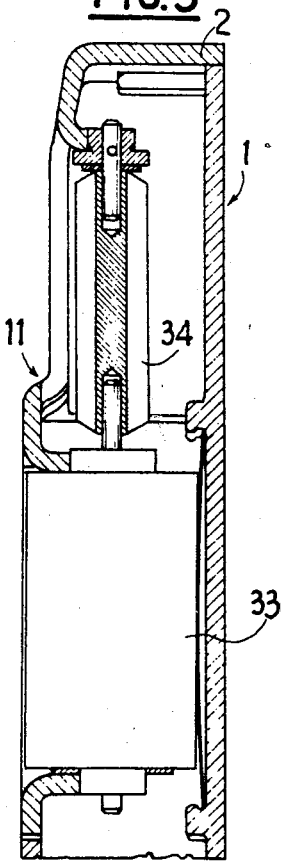
Figure 6:
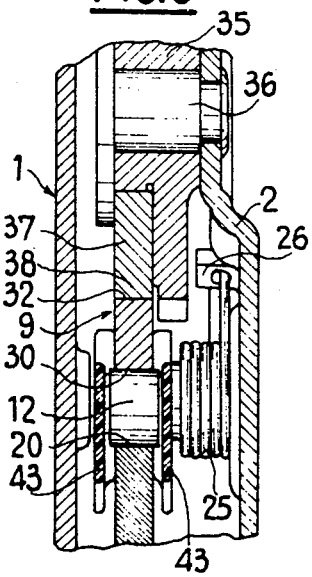
Figure 7:
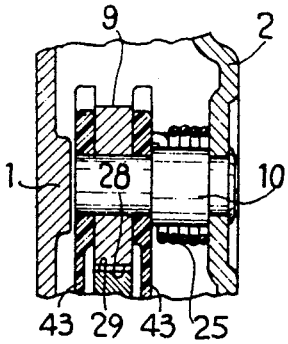
Figure 8:
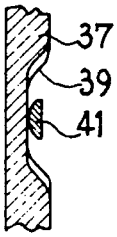

The operating unit 11 comprises an electric driving motor 33 whose output shaft is provided with a worm 34. The latter is meshed with a worm wheel 35 rotatably mounted on a fixed pin 36 (FIGS. 4 and 6). The worm wheel 35 carries a cam ring 37 whose first cam 38 is oriented radially for cooperation with the outer curved edge 32 of the actuating lever 9. The other cam 39 is oriented axially for cooperation with the push member 41 of an electric switch 42.

In a preferred embodiment of the latch structure, the locking means 12 is a roller of circular section whose radius is equal to the radius of the notches 30 and 31 in the shape of an arc of a circle provided in the acutating lever 9. The latter is mounted between the lateral sides of a maintaining fork member 43 whose extent is such that the roller 12 is maintained in position in the notch 20 formed in the plate 15, irrespective of the stage of operation of the latch structure. The fork member 43 is pivotally mounted on the pin 10 and pivots in unison with the actuating lever 9.

Figure 1A:
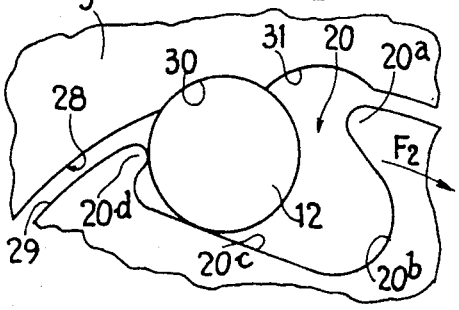
FIG. 1A is a partial view, to an enlarged scale, of a detail of the latch structure of FIG. 1.

FIG. 1A shows, to an enlarged scale, the shape of the notch 20 formed in the edge 29 of the plate 15. If the pivoting movement of the assembly forming the bolt 7 in the direction for opening the latch structure (arrow $F_2$) is considered, the notch 20 is defined by an upstream rounded portion 20*a* forming a thrust nose portion for the locking means 12 and this rounded portion is connected to a surface portion 20*b* roughly in the shape of an arc of a circle and concave, in turn connected to a planar sliding surface 20*c* which terminates in a nose portion 20*d* for maintaining the locking means 12.

Note that the connecting surface 20*b* in the shape of an arc of a circle has a radius less than the radius of the roller or locking means 12. Moreover, the volume of the notch 20 is so chosen that the roller 12 can completely retract within the periphery of the plate 15 which is defined, in the region of the notch 20, by the imaginary line connecting the two portions of the curved edge 29 of the plate 15. In other words, in order to retract, the roller 12 can slide along the planar surface 20*c* and locate itself in the notch portion 20 defined by the connecting surface 20*b*.

It will also be observed that a shock-absorber 44 is disposed in the inner end of the passage 3 and is crushed by the keeper 5 when the latch structure is fully locked.

Figure 9A:
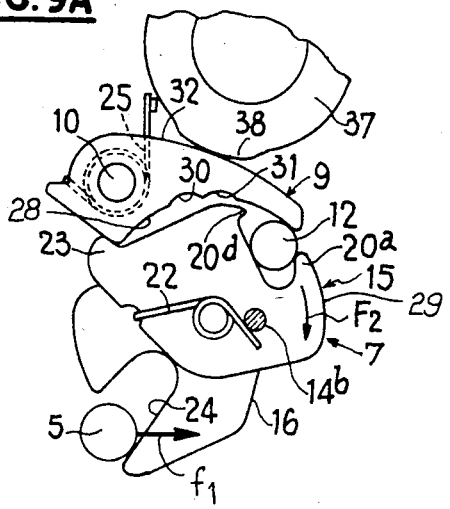
FIGS. 9A to 9F show diagrammatically all the operating stages of the latch structure.
Figure 9D:
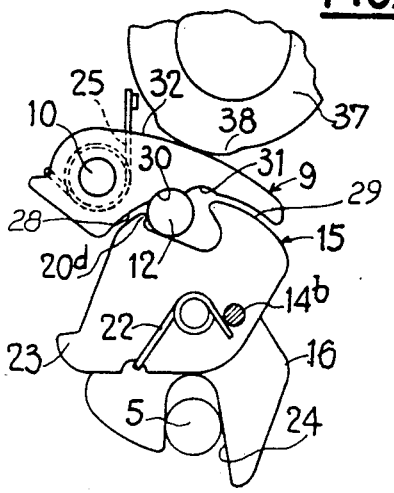
Figure 9B:
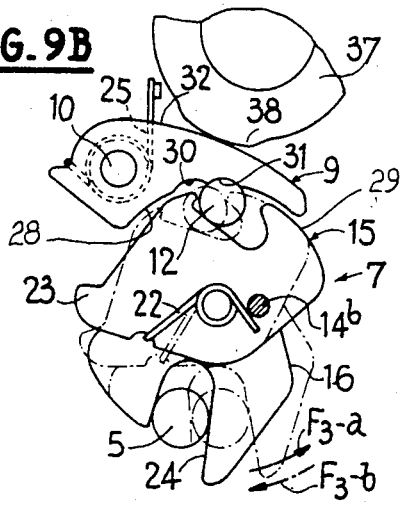
Figure 9E:
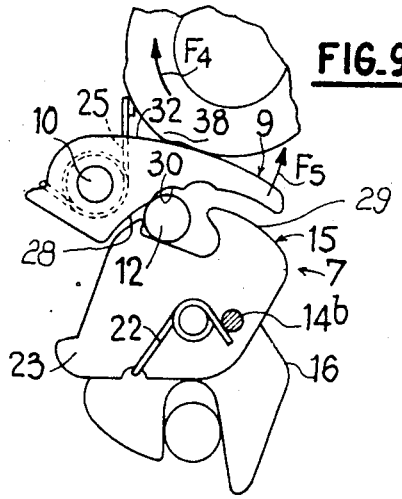
Figure 9C:
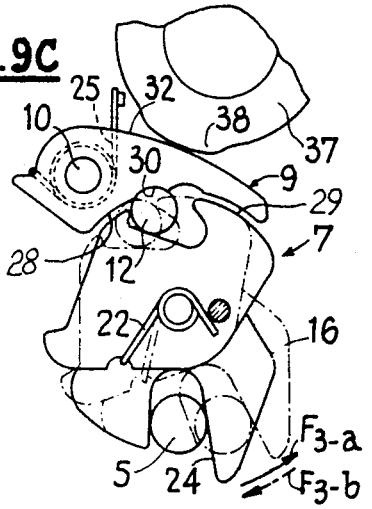
Figure 9F:
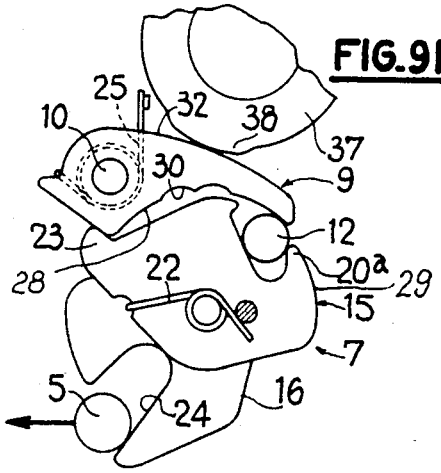

The operation of the latch structure just described will now be examined with reference to FIGS. 9A and 9F.

In FIG. 9A, the latch structure is at rest in the opening position (door open). The bolt 7 is pivoted towards its end, unlocking position, in which it is placed under the action of the spring 22, the position being determined by the heel portion 23 which, in acting as an abutment, comes into bearing relation to the rear edge of the actuating lever 9. The conjugate edges 28 and 29 are offset from each other, the notch 20 being located in confronting relation to the end of the edge 28 which is remote from the pivot pin 10. The locking means or roller 12 is placed in the "upstream" part of the notch 20 with respect to the direction $F_2$ of force for opening the bolt 7. The cam 38 is in contact with the outer convex edge 32 of the actuating lever 9. The electric motor is de-energized.

When the door is closed, the keeper 5 encounters the forked portion of the plate 16 of the bolt 7 and exerts a force $f_1$ on the latter. This force acts in opposition to the action of the spring 22 and, if it is sufficient, starts to rotate the bolt 7 in the counterclockwise direction, the spring 22 being progressively stressed (arrow $F_3$-a; FIG. 9B). The roller 12 is first of all simply transported with the bolt 7 by travelling along the edge 28 of the actuating lever. The movement of the keeper continuing, a moment is reached when the roller 12 is placed in confronting relation to the notch 31 hereinafter termed "first notch". If the user stops the closing movement at that instant, the latch structure will be locked in a closing position termed "first notch" by a slight return movement of the bolt in the opposite direction (arrow $F_3$-b) under the force exerted by the spring 22, which may be optionally assisted by the elastic force produced by the shock-absorber 44 which is assumed to be slightly compressed at this instant by the keeper.

Note that, in general, automobile vehicle latch structures have two latching positions termed "first notch" and "second notch", the "first notch" corresponding to a temporary closure of the door. In this position, the door is not truly held in position and this situation is immediately transmitted to the driver after the vehicle moves off by an unpleasant noise which will cause the driver to stop so as to complete the closure of the door. FIG. 9B therefore shows the latch structure in this particular condition of a "first notch" latching.

Figure 10:
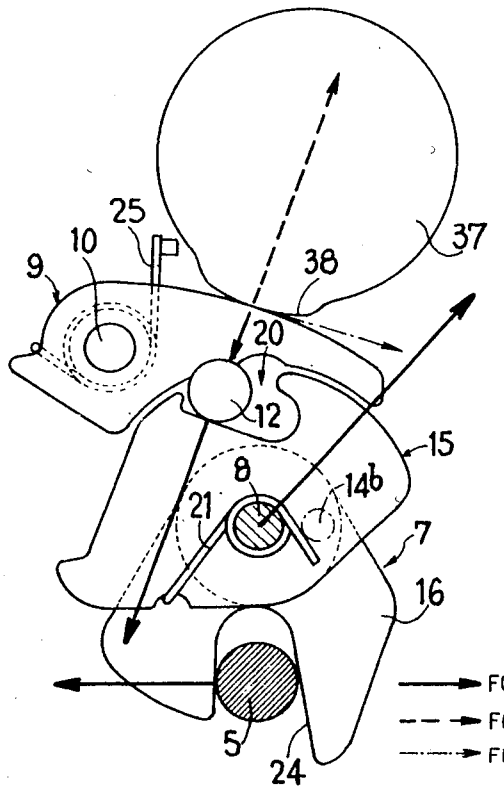
FIG. 10 is a diagrammatic view of the latch structure showing the forces to which its essential parts are subjected.

In order to pass from this position to the following position ("second notch"), the roller 12 must be shifted from the position of FIG. 9B to that of FIG. 9C. As the keeper once again exerts a force on the bolt 7, the latter continues its movement in the direction of arrow $F_3$-a, and this moves the planar surface 20*c* (FIG. 1A) away from the concave edge 28 of the actuating lever 9. The volume available for the roller 12 increases and the latter can consequently leave the notch 31 in which it was previously engaged. As the bolt continues still further its movement, it urges the roller 12 forwardly so that the latter passes over the peak between the two notches 30 and 31. The movement continues until the roller 12 passes in front of the notch 30, at which moment the door has compressed its sealing elements on the post of the vehicle and the keeper has deformed the shock-absorber 44 to the maximum extent (FIG. 1). There again occurs a rearward movement of the bolt 7 which causes the roller 12 to engage in the notch 30 of the actuating lever 9. The assembly is then locked (FIG. 9D), the balance of the forces being that shown in FIG. 10. It can be seen that the roller 12 projects from the periphery of the bolt 7 defined by the curved edge 29, whereas, before, it was retracted within this periphery so as to allow a free movement of rotation of the bolt.

The change from the retracted position of the roller 12 to its projected position is achieved by a slight rearward movement of the keeper during which the planar surface 20*c* of the notch 20 urges the roller outwardly.

In order to unlock or unlatch the latch structure, the motor 33 must be energized so as to rotate the worm wheel 35 in the direction of arrow $F_4$. In this way, the cam 38 leaves the convex edge 32 of the actuating lever 9 and this allows it to rotate about its axis in the direction of arrow $F_5$, it being driven by the force of the spring 25. The volume available to the roller 12 consequently increases and the latter then disengages from the notch 30. The bolt 7 is immediately returned rearwardly, on one hand, by the action of the spring 22 and, on the other hand (as the case may be), by the keeper which is urged back by the shock-absorber 44 and, possibly, by the sealing elements of the door.

If the latch structure is placed vertically as shown in FIG. 1, the roller 12 is then caused to fall under the effect of gravity into the bottom of the notch 20 and is once again positioned in its retracted position. If the latch structure occupies a different position, this movement may be brought about by a spring similar to the spring 55 (then absent) but acting in the opposite direction. But, however this may be and irrespective of the position of the latch structure, the roller 12 is returned to its retracted position as soon as the lever 9 has resumed its initial position, which occurs very rapidly after a complete rotation of the cam 38, i.e. before the bolt has resumed its own position (FIG. 9F).

Figure 11:
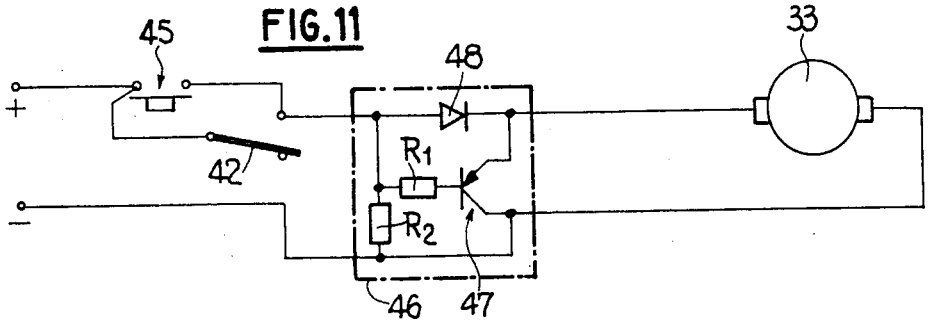
FIG. 11 is an electric diagram of the control circuit of the motor actuating latch structure.

FIG. 11 shows an electric diagram of an embodiment of a control circuit for the motor 33. In this Figure, it can be seen that the latch structure may be controlled by a simple push-button 45 which is connected between one of the terminals of a supply source and a circuit 46 for instantaneously stopping the motor 33. The push-button 45 is connected in parallel with the switch 42 which performs the function of a maintenance contact. The circuit 46 comprises a transistor 47 for shorting the armature of the motor 33. Its collector is connected with one of the terminals of the motor to the opposite terminal of the supply source, whereas its emitter is connected between the cathode of a diode 48 and the opposite terminal of the armature of the motor. The base of the transistor is connected through a resistor $R_1$ to the anode of the diode 48 and to the parallel circuit of the push-button 55 and the switch 42. A resistor $R_2$ connects the collector of the transistor 47 to the anode of the diode 48.

When the push-button 45 is depressed, the motor 33 is supplied with current through the diode 48, the transistor 47 remaining non-conductive, since its base and its emitter are at the same potential. The push-button is immediately replaced by the contact 42 since the cam 39 places its high portion against the push-member 41 owing to the rotation of the worm wheel 35. When the latter has almost finished one rotation, the push-member 41 is again placed in front of the lower portion of the cam 39 and the switch 42 is opened. As the motor 33 continues to rotate under the effect of inertia, it becomes a generator and thus renders the transistor 47 conductive which then shorts this generator. The motor then stops within a fraction of a second which is so calculated by the choice of the values of the components that the cam 38 is exactly in its initial position. According to the diagram of the forces of FIG. 10, it can be seen that the opening of the latch structure requires a force which is no other than the frictional force between the cam 38 and the convex outer surface 32 of the actuating lever. The roller 12 has encountered no obstacle, neither during the locking nor during the unlocking. The electric motor 33 can therefore be of very low power and this enables it to be inserted in the case of the latch structure. Further, it can be seen that the roller 12 is only stressed in the locking position of the latch structure, which is static. In the course of its movements, it moves without being urged against any surface, which reduces the wear to a minimum value. The same is true of the contoured surfaces of the bolt, on one hand, and of the actuating lever on the other.

Figure 12:
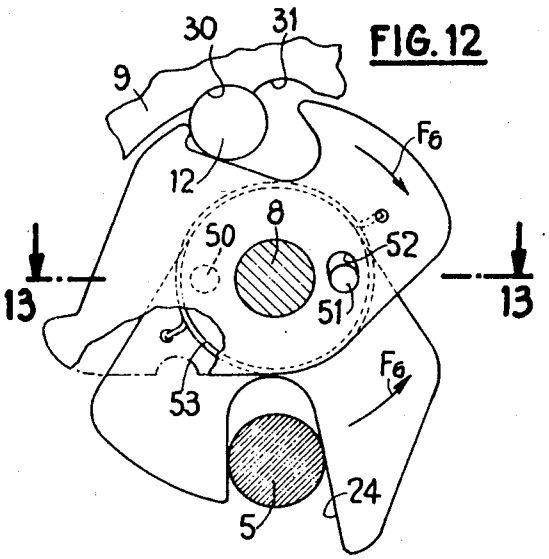
FIG. 12 is a partial sectional and elevational view of a modification of the lock according to the invention.
Figure 13:
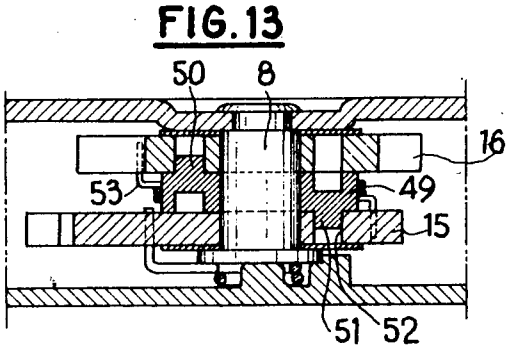
FIG. 13 is a sectional view taken on line 13—13 of FIG. 12.

FIGS. 12 and 13 show a modification of the latch structure in which the two plates 15 and 16 are connected to each other with a possibility of a slight angular movement. For this purpose, they are interconnected by a spacer member 49, which, by a first deformation 50, is rigidly secured to the plate 16, whereas a second deformation 51 is engaged with a slight clearance in an aperture 52 in the shape of a haricot bean formed in the other plate 15. The spacer member is pivotally mounted on the pin 8.

A coil spring 53 is mounted on the pin 8 and is hooked by its respective end portions in the plates 15 and 16 so as to bias them in the direction of arrows $F_6$ about the pin 8.

When the latch structure of FIGS. 12 and 13 is locked (as illustrated), the plates 15 and 16 are in such relative angular position that the deformation 51 bears against one of the ends of the aperture 52, the spring 53 being stressed. As soon as the lever 9 is moved away from the plate 15 for unlocking, the keeper 5 is released and the plate 16 is rotated relative to the plate 15 and the bolt 7 rotates as a whole about the pin 8. Consequently, the roller 12 receives an impulse of movement which rapidly shifts it from its locking position and throws it to the end of the notch 20.

Figure 12A:
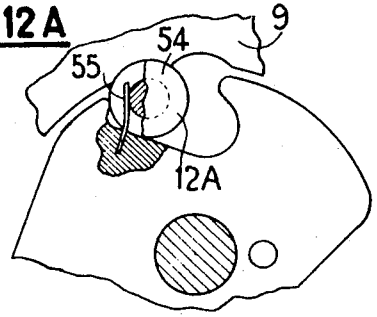
FIG. 12A is a modification of the latch structure for obtaining in another way the result produced by the modification of FIG. 12.

FIG. 12A shows another modification in which there is provided a roller 12A having a circular groove 54 in which can penetrate a spring wire 55 which biases the roller toward the end of the notch 20. This spring 55 is fixed in the plate 16 and extends in a direction roughly perpendicular to the planar surface 20*c* of the notch 20 and is stressed or bent when the roller 12A is in its "second notch" locking position. With this modification, the intention is to obtain the same result as in the modification of FIGS. 12 and 13, namely to guarantee that the roller 12A is placed at the end of the notch 20 as soon as the lever 9 has effected the unlocking.

Figure 15:
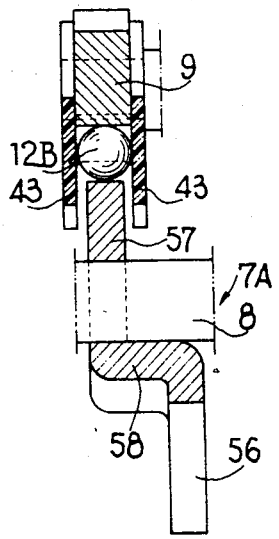
FIG. 15 is a sectional view taken on line 15—15 of FIG. 14.
Figure 14:
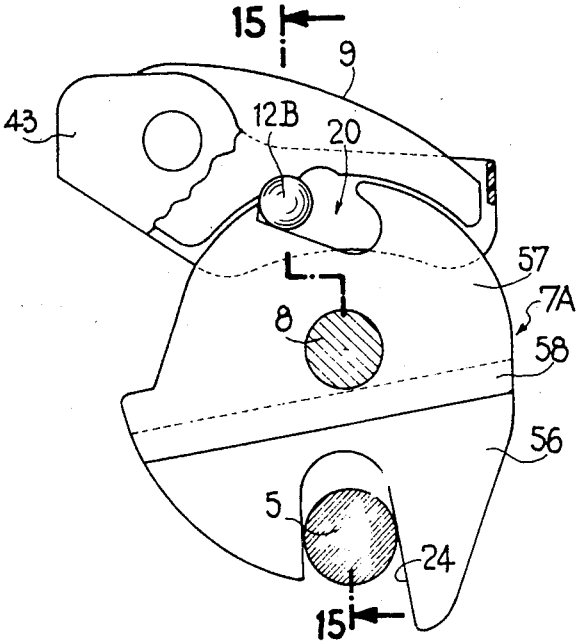
FIG. 14 is a view of another modification of the latch structure.

FIGS. 14 and 15 illustrate another modification in which the latch structure according to the invention comprises a bolt 7A constructed as a single member from a single plate having two plate portions 56 and 57 which are parallel to each other and interconnected by a junction portion 58 perpendicular to these plate portions. The assembly is pivotally mounted on the pin 8 which extends through the plate portion 57. The plate portion 56 defines a forked portion adapted to straddle the keeper 5 for the locking, whereas the plate portion 57 comprises the notch 20.

The modification also comprises a locking means 12B which is here formed by a spherical ball.

This modification operates in the same way as the embodiment shown in FIGS. 1 to 8.

Figure 16:
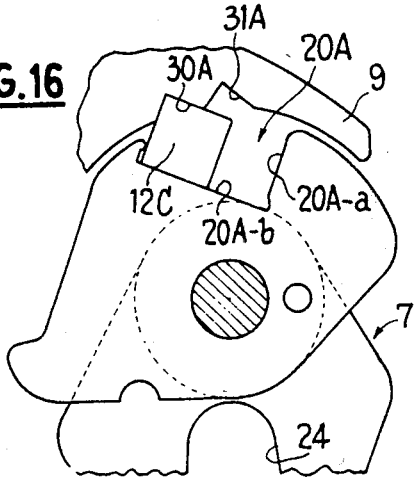
FIGS. 16 and 17 are views of two other modifications of the latch structure according to the invention.

FIG. 16 shows another modification in which the latch structure comprises a locking means 12 constituted by a rectangular parallelepipedic block. In this case, the actuating lever 9 comprises notches 30A and 31A in the shape of a V, and the notch 20A is defined by two mutually perpendicular surfaces 20A-a and 20A-b.

Figure 17:
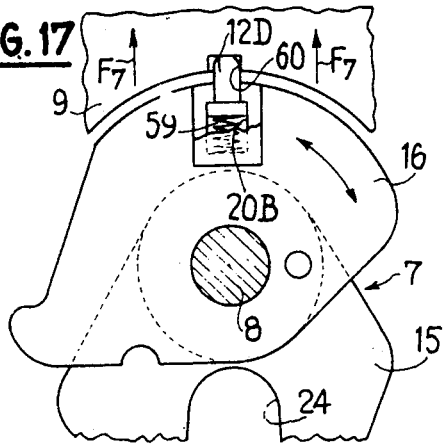

According to the modification shown in FIG. 17, the locking means 12D is in the form of a shouldered cylindrical stud which is mounted in a cavity 20B provided in the plate 16. This stud is biased outwardly by a spring 59. In this case, the actuating lever 9 has a single notch 60 mounted preferably movable in translation instead of being pivotal (see the arrows $F_7$).

Having now described my invention what I claim as new and desire to secure by Letters Patent is:

1. A latch structure, in particular for an automobile vehicle door, the latch structure comprising a case, a mechanism of the latch structure disposed within the case, and a keeper which is movable in a given direction relative to the case, said mechanism comprising a bolt means mounted to pivot about an axis substantially perpendicular to said given direction of movement of the keeper, said bolt means comprising means defining a fork-shaped portion which is cooperable with the keeper, a movable lever for actuating the latch structure, a locking means interposed between the bolt means and the actuating lever, the actuating lever being associated with the bolt means to allow rotation of the bolt means in a direction for releasing the keeper through the locking means, the locking means being mounted to be freely movable in a cavity of a first element of two elements consisting of the bolt means and the actuating lever, from a retracted position for allowing the free movement of rotation of the bolt means relative to the actuating lever and a projecting position for rendering said two elements interconnected, said locking means also being movable from said projecting position to said retracted position relative to said cavity of said first element, the second of said two elements defining, for rendering said two elements interconnected, at least one notch which the locking means is capable of penetrating in said projecting position of said locking means, the first element being the actuating lever and being mounted relative to the case to be movable between a first position in which said locking means is engaged in said notch and a second position in which said locking means is disengaged from said notch, means for biasing the actuating lever to said second position, and a lock operating device associated with said actuating lever selectively for holding said actuating lever in said first position and thereby maintaining said locking means in said notch and for allowing said actuating lever to move to said second position for disengaging the locking means from said notch.

2. A latch structure according to claim 1, wherein said cavity is defined by a contoured edge of said first element, the locking means being loosely mounted in said cavity, said second element having a contoured edge which includes said notch and is located in confronting relation to said contoured edge of said first element in an unlocking position of the latch structure and closes said cavity.

3. A latch structure according to claim 2, wherein said contoured edges both have substantially a shape of an arc of a circle.

4. A latch structure according to claim 2, wherein said locking means is a roller of cylindrical shape.

5. A latch structure according to claim 1, wherein said locking means is a ball of spherical shape.

6. A latch structure according to claim 1, wherein said locking means is a block of generally polygonal shape.

7. A latch structure according to claim 1, wherein said locking means is a cylindrical pin.

8. A latch structure according to claim 4, wherein a portion of the contoured edge of said first element defining said cavity comprises projections at an entrance of said cavity for retaining the locking means in said cavity and there extend in said cavity between said projections a rectilinear portion acting as a sliding surface for the locking means and a concave rounded portion having a radius less than the radius of the locking means.

9. A latch structure according to claim 5, wherein a portion of the contoured edge of said first element defining said cavity comprises at an entrance of said cavity projections for retaining the locking means in said cavity and there extend in said cavity between said projections a rectilinear portion acting as a sliding surface for the locking means and a concave rounded portion having a radius less than the radius of the locking means.

10. A latch structure according to claim 4, wherein the notch of said second element has substantially a shape of an arc of a circle.

11. A latch structure according to claim 5, wherein the notch of said second element has substantially a shape of an arc of a circle.

12. A latch structure according to claim 6, wherein a portion of the contoured edge of said first element defining said cavity comprises two planar surfaces making a given angle therebetween which angle is equal to a corner angle of the polygonal block and a lug is provided for retaining the block at an outer end of one of said planar surfaces.

13. A latch structure according to claim 1 wherein said lever is mounted in the case to pivot about an axis parallel to the axis of the bolt means between said first and second positions thereof.

14. A latch structure, in particular for an automobile vehicle door, the latch structure comprising a case, a mechanism of the latch structure disposed within the case, and a keeper which is movable in a given direction relative to the case, said mechanism comprising a bolt means mounted to pivot about an axis substantially perpendicular to said given direction of movement of the keeper, said bolt means comprising means defining a fork-shaped portion which is cooperable with the keeper, a movable lever for actuating the latch structure, a locking means interposed between the bolt means and the actuating lever, the actuating lever being associated with the bolt means to allow rotation of the bolt means in a direction for releasing the keeper through the locking means, the locking means being mounted to be movable in a first element of two elements consisting of the bolt means and the actuating lever, between a projecting position for rendering said elements interconnected and a retracted position for allowing the free movement of rotation of the bolt means relative to the actuating lever, the second of said two elements defining, for rendering said elements interconnected, at least one notch which the locking means is capable of penetrating, and said two elements being mounted in such manner as to be capable of moving away from each other for allowing the locking means to leave the notch defined by said second element, said first element being said bolt means and said second element being said actuating lever, which lever is mounted in the case to pivot about an axis parallel to the axis of the bolt means, said actuating lever being provided with a spring which biases the lever in a direction which moves the actuating lever away from said bolt means and the actuating lever being cooperative with an operating device which comprises a cam allowing temporarily the movement of the actuating lever away from the bolt means when unlocking the latch structure for the purpose of releasing said locking means from said notch.

15. A latch structure according to claim 14, wherein the operating device comprises an electric motor, a gear wheel drivenly connected to the electric motor and associated with the cam, which cam is arranged to maintain constantly the contoured edge of the actuating lever in the vicinity of the conjugate contoured edge of the bolt means in opposition to the action of said spring, except during an unlocking stage of the operation of the latch structure.

16. A latch structure according to claim 15, wherein said electric motor is supplied with power through means comprising an unlocking control push-button and a maintaining contact connected in parallel with the control push-button, said maintaining contact being arranged to be closed during the rotation of said gear wheel and open when said cam maintains the actuating lever in the vicinity of the bolt means.

17. A latch structure according to claim 16, wherein the electric motor is supplied with power through a control circuit which shorts the armature of the motor when the motor is not supplied with power.

18. A latch structure according to claim 14, wherein said bolt means is provided with a spring which is mounted in such manner as to bias the bolt means to its unlocking position and the bolt means comprises a nose portion for limiting the travel of the bolt means in the opening position by bearing against a fixed abutment.

19. A latch structure according to claim 14, wherein the bolt means is constructed from two parallel plates mounted to rotate about the pivot axis of the bolt means with interposition of a spacer member and one of the plates defines said fork-shaped portion and the other of said plates defines said contoured edge.

20. A latch structure, in particular for an automobile vehicle door, the latch structure comprising a case, a mechanism of the latch structure disposed within the case, and a keeper which is movable in a given direction relative to the case, said mechanism comprising a bolt means mounted to pivot about an axis substantially perpendicular to said given direction of movement of the keeper, said bolt means comprising means defining a fork-shaped portion which is cooperable with the keeper, a movable lever for actuating the latch structure, a locking means interposed between the bolt means and the actuating lever, the actuating lever being associated with the bolt means to allow rotation of the bolt means in a direction for releasing the keeper through the locking means, the locking means being mounted to be movable in a first element of two elements consisting of the bolt means and the actuating lever, between a projecting position for rendering said elements interconnected and a retracted position for allowing the free movement of rotation of the bolt means relative to the actuating lever, the second of said two elements defining, for rendering said elements interconnected, at least one notch which the locking means is capable of penetrating, and said two elements being mounted in such manner as to be capable of moving from each other for allowing the locking means to leave the notch defined by said second element, said first element being said bolt means and said second element being said actuating lever, which lever is mounted in the case to pivot about an axis parallel to the axis of the bolt means, the bolt means being constructed from two parallel plates mounted to rotate about the pivot axis of the bolt means with interposition of a spacer member and one of the plates defining said fork-shaped portion and the other of said plates defining said contoured edge, said plates being angularly movable relative to each other in opposition to the action of a spring which biases the plates in opposite directions, the plate carrying the forked portion being biased by said spring in a direction for unlocking the latch structure.

21. A latch structure according to claim 7, wherein said cylindrical pin is slidably mounted in the cavity of said first element and is biased outwardly of said first element by elastically yieldable means.

22. A latch structure according to claim 4, comprising an elastically yieldable means in said cavity of said first element for biasing said locking means to a position of the locking means in which the locking means is retracted into said first element.

23. A latch structure, in particular for an automobile vehicle door, the latch structure comprising a case, a mechanism of the latch structure disposed within the case, and a keeper which is movable in a given direction relative to the case, said mechanism comprising a bolt means mounted to pivot about an axis substantially perpendicular to said given direction defining a fork-shaped portion which is cooperable with the keeper, a movable lever for actuating the latch structure, a locking means interposed between the bolt means and the actuating lever, the actuating lever being associated with the bolt means to allow rotation of the bolt means in a direction for releasing the keeper through the locking means, a cavity provided in the bolts means, the locking means being freely movable in said cavity, from a retracted position for allowing the free movement of rotation of the bolt means relative to the actuating lever and a projecting position for rendering the actuating lever and the bolt means interconnected, said locking means being also movable from the projecting position to said retracted position for allowing rotation of the bolt means, the actuating lever defining, for rendering the actuating lever and the bolt means interconnected, at least one notch which the locking means is capable of penetrating in said projecting position of said locking means, and said actuating lever being mounted in said case in such manner as to be movable freely away from the bolt means to a first position for disengaging the notch from said locking means and allowing the bolt means to pivot and permit the escape of the keeper from the fork-shaped portion of the bolt means, the actuating lever being also movable in a direction toward the bolt means to a second position in which second position it enables the locking means to enter said notch and prevent a rotation of the bolt means in a direction to release the keeper, and elastically yieldable means for biasing said actuating lever towards released keeper position, an a cam device combined with the actuating lever for shifting the actuating lever between said first position and said second position thereof.

* * * * *